US007828413B2

(12) United States Patent
Wu

(10) Patent No.: US 7,828,413 B2
(45) Date of Patent: Nov. 9, 2010

(54) POSITIONING APPARATUS AND PRINTER USING THE SAME

(75) Inventor: Sheng-Chang Wu, Taipei County (TW)

(73) Assignee: Kinpo Electronics, Inc., Taipei County (TW)

( * ) Notice: Subject to any disclaimer, the term of this patent is extended or adjusted under 35 U.S.C. 154(b) by 506 days.

(21) Appl. No.: 12/043,021

(22) Filed: Mar. 5, 2008

(65) Prior Publication Data

US 2009/0160904 A1 Jun. 25, 2009

(30) Foreign Application Priority Data

Dec. 20, 2007 (TW) ..... 96148973 A

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS 5,434,602 A * 7/1995 Kaburagi et al. ..... 346/139 R
2003/0081041 A1* 5/2003 Allen et al. ..... 347/19

FOREIGN PATENT DOCUMENTS

CN 2254403 5/1997
CN 101017100 8/2007
EP 1 669 724 6/2006

OTHER PUBLICATIONS

Chinese First Examination Report of China Patent Application No. 200810003216.8, dated Feb. 25, 2010.

* cited by examiner

*Primary Examiner*—Jerry T Rahll
(74) *Attorney, Agent, or Firm*—J.C. Patents

(57) ABSTRACT

A positioning apparatus and a printer using the same are provided. The positioning apparatus includes a slide rod, a carrying base, and a light detecting module. The slide rod has a plurality of positioning grooves on one side surface thereof, and the carrying base is slidingly disposed on the slide rod. The light detecting module is integrated with the carrying base and corresponds to the side surface of the slide rod having the positioning grooves. The light detecting module determines a relative position of the light detecting module with respect to the slide rod according to the intensity change of a reflection light reflected by the slide rod.

13 Claims, 4 Drawing Sheets

POSITIONING APPARATUS AND PRINTER USING THE SAME

CROSS-REFERENCE TO RELATED APPLICATION

This application claims the priority benefit of Taiwan application serial no. 96148973, filed on Dec. 20, 2007. The entirety of the above-mentioned patent application is hereby incorporated by reference herein and made a part of this specification.

BACKGROUND OF THE INVENTION

1. Field of the Invention

The present invention generally relates to a printer, in particular, to a printer having an ink head positioning apparatus.

2. Description of Related Art

As people have gradually stepped into a higher living standard, the computer system used to be utilized by professionals has become a daily necessity for the mass in daily life. In order to satisfy different requirements of the public, many peripherals have also been proposed accordingly. However, due to so many competitors in similar fields, each manufacturer must continuously improve the quality of the product, so as to win the favour from more customers.

For example, in the past, people are satisfied with printing the documents through using a conventional dot-matrix printer. Nowadays, besides simple single-color document, people usually use the printer to print high-definition patterns, for example, pictures or advertisements. In other words, as an attractive printer, it must be capable of printing high-quality patterns.

In order to make the pattern printed by the printer be more perfect, the positioning of the ink head in an inkjet printer is quite important. The reason lies in that, if the positioning of the ink head is poor, it cannot paint the correct color at the correct position, such that the quality of the pattern is greatly deteriorated. Referring to FIG. 1A below, it is a schematic view of a conventional inkjet printer. In a conventional printer 100, a light 141 emitted from a light emitting diode (LED) 140 mounted on the slide rod 110 is irradiated on an encoder strip 120, and then, a carriage encoder sensor 130 is used to detect whether the light passes through or not, so as to position a moving distance of the ink head.

Referring to FIG. 1B below, it is a schematic view of waveforms for the positioning detection of an ink head of the conventional printer. The encoder sensor 130 simultaneously detects lights at two positions, and generates corresponding signal waveforms and voltages at a signal output end PA and a signal output end PB. Once the encoder sensor 130 detects that the light passes through the encoder strip 120, an output voltage is a high voltage V1. On the contrary, if no light passes through the encoder strip 120, a low voltage V2 is output. In this manner, when the ink head moves left and right along the slide rod 110, the position of the ink head can be controlled, as long as the voltage relationship between the signal output end PA and the end PB is used.

However, the positioning apparatus further requires the encoder strip 120, in which the conventional encoder strip 120 is made of a plastic material. However, a plurality of strips of black raw material (ink printing materials) is mainly coated on a surface of the encoder strip, and the oil stains are easily attached to the encoder strip 120 made of plastic material, so as to result in mis-determination of the system. Therefore, some manufacturers use the metal material to make the encoder strip 120, and the encoder strip 120 must be light transmissive, so it has many slight openings. In practical operation environment, not only the slight openings may be shielded by some particles (the particles here include dusts in the air, and suspended aerosols in the ink), but the encoder strip 120 may also be slightly deformed due to the temperature change after being used for a long time. All the above factors may cause the poor positioning of the ink head of the printer 100, so as to seriously affect the printing quality.

SUMMARY OF THE INVENTION

Accordingly, in order to improve the printing quality of the printer, the present invention is directed to a positioning apparatus, which performs positioning by using a reflection light generated by positioning grooves on a slide rod, thereby designing a sliding positioning apparatus.

The present invention is also directed to a printer, in which the optical positioning of the ink head is performed by using the grooves on the slide rod instead of the encoder strip, thereby reducing the manufacturing cost of the printer.

The present invention provides a positioning apparatus, for positioning the ink head. The positioning apparatus includes a slide rod, a carrying base, and a light detecting module. The side rod has a plurality of positioning grooves on the same side surface. The carrying base is slidingly disposed on the slide rod. In addition, the light detecting module is integrated with the carrying base and corresponds to the side surface of the slide rod having the positioning grooves. The light detecting module has a positioning light source, and determines a relative position of the light detecting module with respect to the slide rod according to a reflection light reflected by the slide rod.

In an embodiment of the present invention, the carrying base is used to carry an ink cartridge.

In an embodiment of the present invention, the light detecting module generates a first voltage according to the reflection light reflected by bottom parts of the positioning grooves, and generates a second voltage according to the reflection light reflected by the part other than the positioning grooves.

In an embodiment of the present invention, the light detecting module calculates the relative position of the light detecting module with respect to the slide rod according to the first voltage and the second voltage.

In an embodiment of the present invention, the positioning grooves are etched on the slide rod.

In an embodiment of the present invention, the bottom parts of the positioning grooves are plated by a material with a dark color.

In an embodiment of the present invention, the positioning light source is at least one optical reflective LED and at least one receiver module.

The present invention provides a printer, which includes a body, a slide rod, a carrying base, and a light detecting module. The slide rod has a plurality of positioning grooves on the same side surface. The carrying base is used to carry an ink cartridge, and is slidingly disposed on the slide rod. The light detecting module is integrated with the carrying base, and corresponds to the side surface of the slide rod having the positioning grooves. The light detecting module has a positioning light source, and determines a relative position of the light detecting module with respect to the slide rod according to a reflection light reflected by the slide rod.

In an embodiment of the present invention, the light detecting module generates a first voltage according to the reflection light reflected by bottom parts of the positioning grooves, and generates a second voltage according to the reflection light reflected by the part other than the positioning grooves.

In an embodiment of the present invention, the light detecting module calculates the relative position of the light detecting module with respect to the slide rod according to the first voltage and the second voltage.

In an embodiment of the present invention, the positioning grooves are etched on the slide rod.

In an embodiment of the present invention, the bottom parts of the positioning grooves are plated by a material with a dark color.

In an embodiment of the present invention, the positioning light source is at least one optical reflective LED and at least one receiver module.

In the present invention, the brightness of different reflection lights respectively reflected by the positioning grooves and the smooth plane on the slide rod is used to detect and determine the relative position of the carrying base with respect to the slide rod, thereby designing a positioning apparatus capable of sliding. The positioning apparatus can be directly applied in the printer, and it can be directly used to carry the ink cartridge and position the ink head. In the present invention, the function of positioning the ink head can be achieved without requiring the encoder strip used in the conventional art, so as to reduce the manufacturing cost of the printer.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
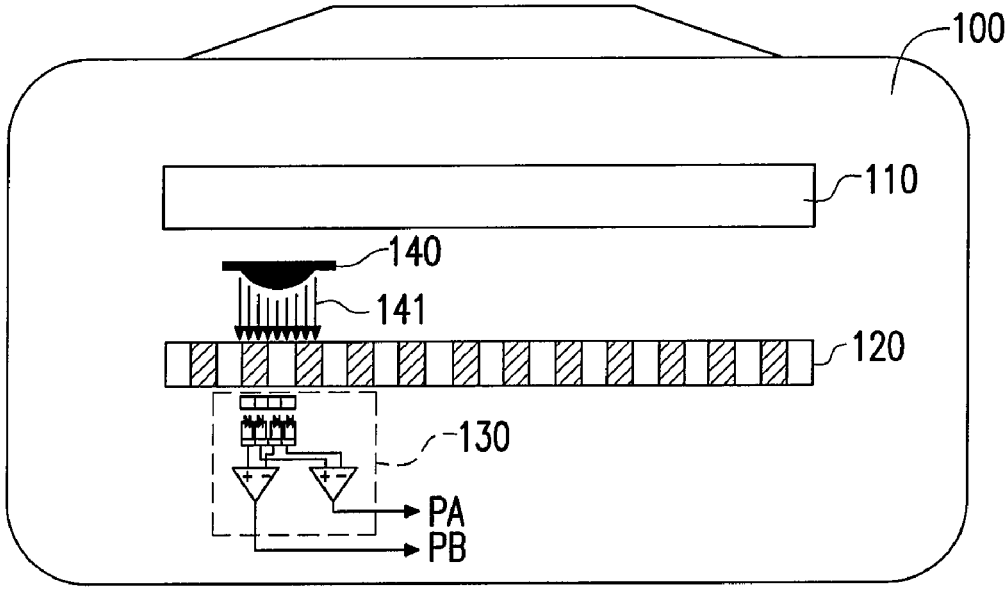
FIG. 1A (PRIOR ART)
FIG. 1A is a schematic view of a conventional inkjet printer.
Figure 1B:
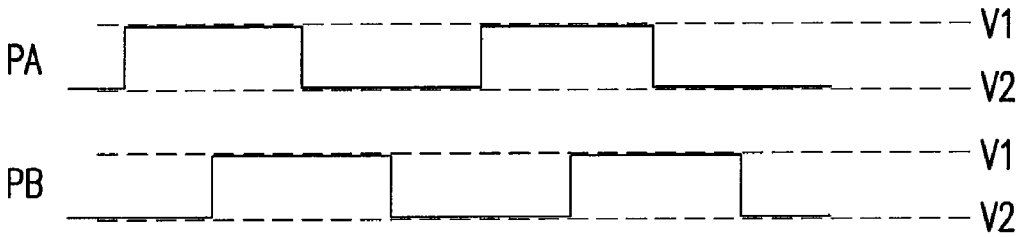
FIG. 1B (PRIOR ART)
FIG. 1B is a schematic view of waveforms for the positioning detection of an ink head of the conventional printer.

Reference will now be made in detail to the present embodiments of the invention, examples of which are illustrated in the accompanying drawings. Wherever possible, the same reference numbers are used in the drawings and the description to refer to the same or like parts.

First Embodiment

Firstly, a structure of the positioning apparatus according to an embodiment of the present invention is illustrated, such that those of ordinary skill in the art can understand the hardware structure of the positioning apparatus in the present invention.

Figure 2A:
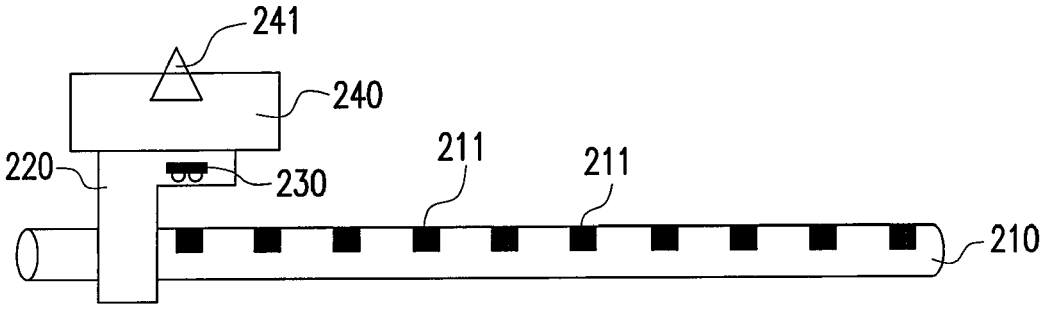
FIG. 2A is a schematic view of a positioning apparatus according to a first embodiment of the present invention.

FIG. 2A is a schematic view of a positioning apparatus according to a first embodiment of the present invention. Referring to FIG. 2A, a positioning apparatus 200 includes a slide rod 210, a carrying base 220, and a light detecting module 230. A smooth plane 213 is formed on a side surface of the slide rod 210, and on the same side surface, many positioning grooves 211 are further formed through etching. The light detecting module 230 is integrated with the carrying base 220, and the carrying base 220 is slidingly disposed on the slide rod 210 and can slide left and right along the slide rod 210. In this embodiment, once the carrying base 220 slides on the slide rod 210, the light detecting module 230 uses a positioning light source to generate an incident light onto the slide rod 210, and determines the relative position of the light detecting module 230 with respect to the slide rod 210 by means of detecting a reflection light reflected back from the slide rod 210.

Figure 2B:
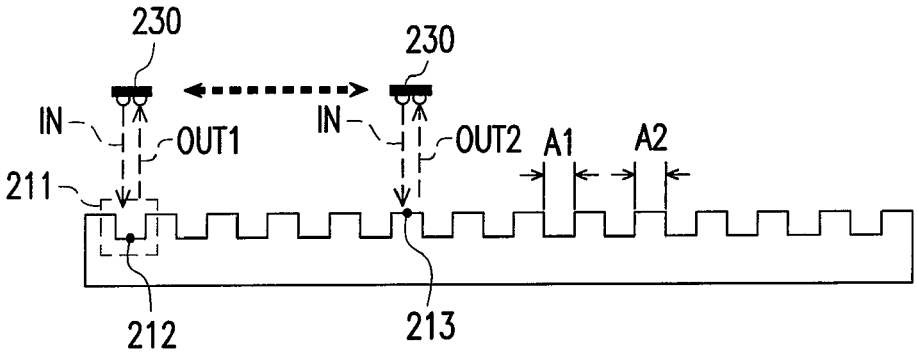
FIG. 2B is a schematic view of the positioning manner according to the first embodiment of the present invention.
Figure 2C:
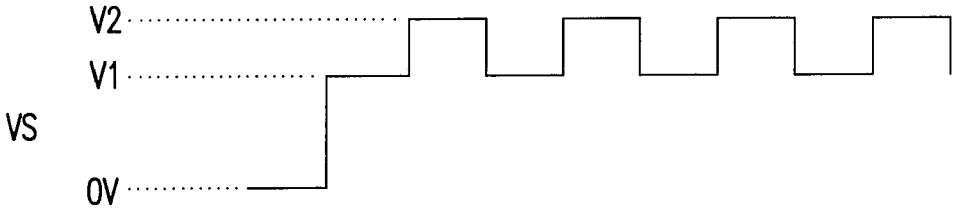
FIG. 2C shows detection waveforms of a light detecting module according to the first embodiment of the present invention.

The positioning manner of the positioning apparatus 200 is further explained below. Referring to FIG. 2B, it is a schematic view of a positioning manner according to the first embodiment of the present invention. The position of the positioning light source of the light detecting module 230 corresponds to the side surface of the slide rod 210 having the positioning grooves 211, and the incident light IN generated by the positioning light source may be irradiated onto the positioning grooves 211 or the smooth plane 213 on the slide rod 210, so as to generate a reflection light OUT1 and a reflection light OUT2 with different intensities. When the light detecting module 230 slides on the slide rod 210, the intensities of the reflection lights OUT1 and OUT2 received by the light detecting module 230 are changed as the reflection lights OUT1 and OUT2 are reflected by different reflection regions, for example, the bottom parts 212 of the positioning grooves 211 or the smooth plane 213 on the slide rod 210.

the light detecting module 230 can output corresponding sensing signals (the voltage change) according to the intensity of the sensed reflection light. As shown in FIG. 2C, it shows detection waveforms of a light detecting module according to the first embodiment of the present invention. An output voltage VS of the light detecting module 230 changes with the intensity of the reflection light (OUT1 or OUT2), as shown in FIG. 2C. When the reflection region corresponding to the light detecting module 230 is the positioning grooves 211, the reflection light OUT1 is relatively weak (dark), and the voltage level of the corresponding output voltage VS is voltage V1; when the reflection region corresponding to the light detecting module 230 is the smooth plane 213, the reflection light OUT2 is relatively strong (bright), and the voltage level of the corresponding output voltage VS is voltage V2, in which the voltage V2 is larger than the voltage V1. The light detecting module 230 can determine the relative position of the light detecting module 230 with respect to the slide rod 210 through counting the voltage pulse of the output voltage signal VS.

It can be easily known from the above illustration that, since the light detecting module 230 is disposed on the carrying base 220, so when the carrying base 220 moves along the slide rod, the light detecting module 230 generates a voltage signal switching between the voltage V1 and the voltage V2. Referring to FIG. 2C, when the voltage signal VS is transited from the voltage V1 to the voltage V2 and then back to the voltage V1, it indicates that the moving distance of the carrying base 220 is equal to the distance A2 between two positioning grooves 211. Similarly, when the voltage signal VS is transited from the voltage V2 to the voltage V1 and then back to the voltage V2, it indicates that the moving distance of the carrying base 220 is equal to a pitch A1 of the positioning grooves (referring to FIG. 2B). As known from the above illustrations that, in the first embodiment, the light detecting module 230 can calculate the relative position of the light detecting module 230 with respect to the slide rod 210 merely through calculating the times for the voltage signal VS to be transited between the voltage V1 and the voltage V2.

For example, it is assumed that the sum of the pitch A1 and the distance A2 between two positioning grooves 211 is 1/150 inch, and in the waveforms of the voltage signal VS, the voltage V1 is transited to the voltage V2 for totally four times, that is, it indicates that the light detecting module 230 moves for 1/150*4=4/150 inch from the origin on the slide rod 210.

It should be noted that, in order to more stably determine the relative position of the light detecting module 230 with respect to the slide rod 210 in the first embodiment, a layer of material with a dark color may be further plated on the bottom parts 212 of the positioning grooves 211, and meanwhile, the positioning light source of the light detecting module 230 may also use an optical reflective LED. Through the straightforward light characteristics of the reflective LED, the reflection light becomes more stable. Through plating a layer of material with a dark color on the bottom parts 212 of the positioning grooves 211, the contrast between the reflection light OUT1 and the reflection light OUT2 is increased, which is easier to be recognized.

In addition, the positioning apparatus 200 in the first embodiment can be applied to the inkjet printer and directly used to carry the ink cartridge 240, and the light detecting module 230 is used as the positioning apparatus for the ink head 241.

Second Embodiment

Figure 3:
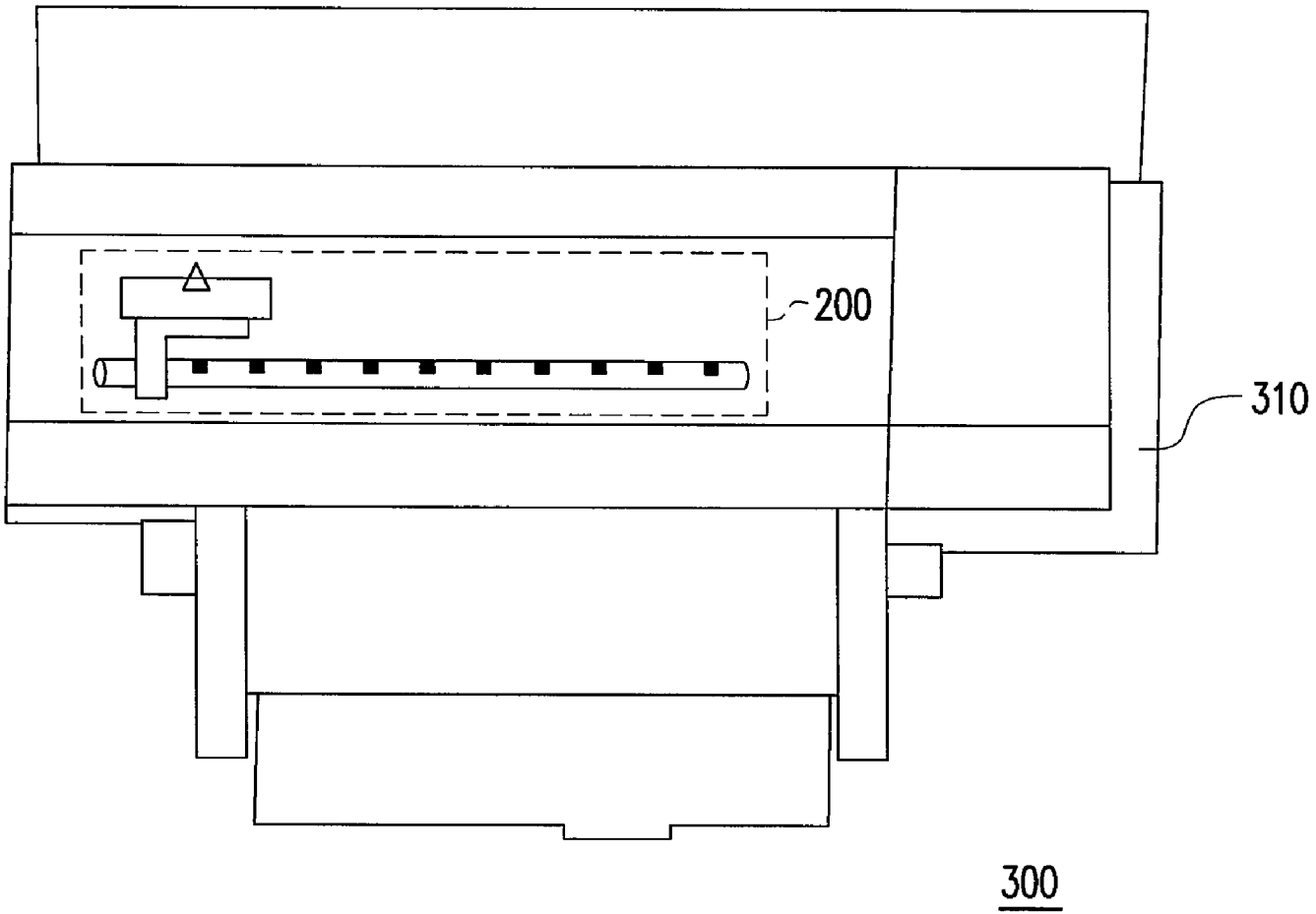
FIG. 3 is a schematic view of a printer according to a second embodiment of the present invention.

Referring to FIG. 3, it is a schematic view of a printer according to a second embodiment of the present invention. The positioning apparatus 200 is disposed in a body 310 of a printer 300. The positioning apparatus 200 is used to carry the ink cartridge 240 and to position the ink head 241. The operation manner of the positioning apparatus 200 has already been described in detail in the first embodiment, which thus will not be described herein. It should be noted that, after the positioning apparatus 200 is disposed in the printer 300, it does not require the encoder strip used in the conventional art, so that the manufacturing cost is reduced.

Figure 4:
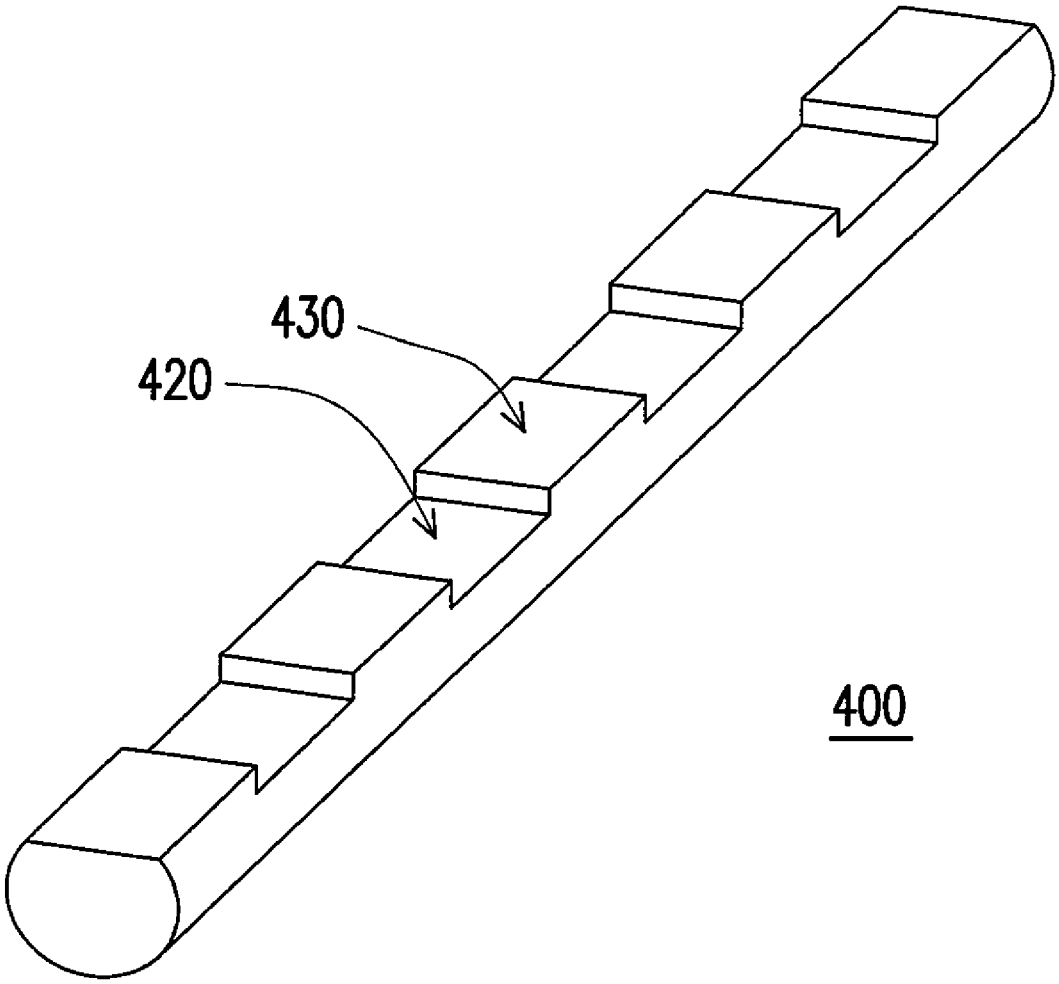
FIG. 4 is a three-dimensional view of an implementing manner of a slide rod according to the present invention.

In addition, referring to FIG. 4, it is a three-dimensional view of an implementing manner of a slide rod according to the present invention. The structure of a slide rod 400 can be clearly known with reference to FIG. 4. A plurality of positioning grooves 420 is etched on a side surface of the slide rod 400 with a smooth plane 430.

To sum up, in the present invention, the relative position of the light detecting module with respect to the slide rod is determined through utilizing the different intensities of the reflection lights caused by being reflected by two different reflection regions of the positioning grooves and the smooth plate. On one aspect, the ink head can be accurately positioned, and on the other aspect, it does not require the encoder strip, so as to eliminate the defect of the inaccurate positioning of the ink head caused by using the encoder strip, such that the printer becomes more stable.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A positioning apparatus, for positioning an ink head, comprising:

a slide rod, comprising a plurality of positioning grooves on one side surface thereof;

a carrying base, slidingly disposed on the slide rod; and a light detecting module, integrated with the carrying base and corresponding to the side surface of the slide rod;

wherein the light detecting module has a positioning light source, and determines a relative position of the light detecting module with respect to the slide rod according to a reflection light reflected by the slide rod.

2. The positioning apparatus according to claim 1, wherein the carrying base is used to carry an ink cartridge.

3. The positioning apparatus according to claim 1, wherein the light detecting module generates a first voltage according to the reflection light reflected by bottom parts of the positioning grooves, and generates a second voltage according to the reflection light reflected by a part other than the positioning grooves.

4. The positioning apparatus according to claim 3, wherein the light detecting module calculates a relative position of the light detecting module with respect to the slide rod according to the first voltage and the second voltage.

5. The positioning apparatus according to claim 1, wherein the positioning grooves are etched on the slide rod.

6. The positioning apparatus according to claim 1, wherein the bottom parts of the positioning grooves are further plated by a material with a dark color.

7. The positioning apparatus according to claim 1, wherein the positioning light source is an optical reflective light emitting diode (LED).

8. A printer, comprising:

a body;

a slide rod, comprising a plurality of positioning grooves on one side surface thereof;

a carrying base, for carrying an ink cartridge and slidingly disposed on the slide rod; and a light detecting module, integrated with the carrying base and corresponding to the side surface of the slide rod;

wherein the light detecting module comprises a positioning light source, and determines a relative position of the light detecting module with respect to the slide rod according to a reflection light reflected by the slide rod.

9. The printer according to claim 8, wherein the light detecting module generates a first voltage according to the reflection light reflected by bottom parts of the positioning grooves, and generates a second voltage according to the reflection light reflected by a part other than the positioning grooves.

10. The printer according to claim 9, wherein the light detecting module calculates a relative position of the light detecting module with respect to the slide rod according to the first voltage and the second voltage.

11. The printer according to claim 8, wherein the positioning grooves are etched on the slide rod.

12. The printer according to claim 8, wherein the bottom parts of the positioning grooves are plated by a material with a dark color.

13. The printer according to claim 8, wherein the positioning light source is a reflective LED.

* * * * *